US007160233B2

(12) United States Patent
Perez

(10) Patent No.: US 7,160,233 B2
(45) Date of Patent: Jan. 9, 2007

(54) ABDOMINAL EXERCISE DEVICE

(75) Inventor: Charles Perez, Venice, CA (US)

(73) Assignee: Concepts to Retail, LLC, Rolling Hills Estates, CA (US)

( * ) Notice: Subject to any disclaimer, the term of this patent is extended or adjusted under 35 U.S.C. 154(b) by 310 days.

(21) Appl. No.: 10/307,044

(22) Filed: Nov. 27, 2002

(65) Prior Publication Data

US 2004/0063555 A1 Apr. 1, 2004

Related U.S. Application Data

(63) Continuation-in-part of application No. 10/256,444, filed on Sep. 26, 2002, now abandoned.

(51) Int. Cl.
*A63B 26/00* (2006.01)
*A63B 71/00* (2006.01)

(52) U.S. Cl. ..... 482/140; 482/145; 482/146

(58) Field of Classification Search ..... 482/51, 482/92, 95–96, 131–132, 139–140, 142–146, 482/9; 606/240

See application file for complete search history.

(56) References Cited

U.S. PATENT DOCUMENTS 3,716,230 A * 2/1973 Mark ..... 482/142
4,494,532 A * 1/1985 Masuda et al. ..... 482/38
4,521,013 A 6/1985 Dofel
4,600,196 A 7/1986 Jones
4,753,438 A * 6/1988 Paris et al. ..... 482/144
5,112,287 A 5/1992 Brewer
5,334,120 A * 8/1994 Rasmussen ..... 482/97
5,551,937 A * 9/1996 Kwo ..... 482/144
5,582,563 A * 12/1996 Fan ..... 482/96
5,722,917 A * 3/1998 Olschansky et al. ..... 482/72
5,769,766 A 6/1998 Huang
5,776,039 A 7/1998 Perez, Jr.
5,885,197 A * 3/1999 Barton ..... 482/144
5,971,902 A * 10/1999 Robertson et al. ..... 482/142
6,022,304 A 2/2000 Tornabene et al.
6,162,153 A 12/2000 Perez, Jr. et al.
6,283,900 B1 9/2001 Tornabene
6,379,289 B1 * 4/2002 Gossie ..... 482/142
6,390,959 B1 5/2002 Tornabene et al.
6,679,818 B1 * 1/2004 Hsien ..... 482/144
2003/0158018 A1 * 8/2003 Giannelli et al. ..... 482/95
2003/0162639 A1 * 8/2003 Hsien
2004/0176227 A1 * 9/2004 Endelman ..... 482/142

FOREIGN PATENT DOCUMENTS

WO WO 9727904 A1 * 8/1997

* cited by examiner

*Primary Examiner*—Lori Amerson
(74) *Attorney, Agent, or Firm*—Kelly Lowry & Kelley, LLP

(57) ABSTRACT

An exercise apparatus that will exercise at least five groups of muscles is disclosed. The exercise apparatus exercises the abdominal muscles, the serratus muscles, the intercostals muscles and the leg muscles. The apparatus uses a seated position for the person exercising and the exerciser is seated on a swing. When the exerciser contracts his or her abdominal muscles while lifting the legs, the swing rotates such that the exerciser's feet rotate upward. When the exerciser releases tension on the abdominal muscles, the apparatus goes back to its original position. When the exerciser bends forward, the above four groups of muscles are exercised.

13 Claims, 3 Drawing Sheets

ABDOMINAL EXERCISE DEVICE

RELATED APPLICATION

This application is a Continuation-in-Part of U.S. application Ser. No. 10/256,444 filed Sep. 26, 2002 now abandoned.

BACKGROUND OF THE INVENTION

The present invention generally relates to exercise devices. More particularly, the present invention relates to an abdominal exercise device which can be used at home.

There exists a wide variety of exercise devices that provide a cardiovascular or resistance exercise to various muscle groups the body. Among these there are known a variety of abdominal exercise devises. In the gym setting, these devices are large, cumbersome, often difficult to operate, and relatively expensive.

While such devices are generally adequate in the gym setting due to the large space available in such settings, such devices are not amiable to the household setting. For home use, the exercise device must not only be effective, but also compact and/or collapsible in order to easily transport and store the exercise device. The exercise device must also be relatively simple in operation and inexpensive.

There exist a number of abdominal exercise devices intended for use in the home setting. However, these devices have certain drawbacks in that they are not easily collapsible, or only exercise only a limited number of abdominal muscles. Some of these exercise devices place unnecessary and dangerous strain and stress on the neck and back of the user of the device. To avoid such strain and stress, the user should be preferably seated in an upright position. Many of these devices are not adjustable to meet the individual size of the user.

Accordingly, there is a continuing need for an abdominal exercise device which is suited for home use. Such an abdominal exercise device should be collapsible in order to be easily transported and stored. Such an exercise devise should also be relatively simple in operation and inexpensive. Preferably, such an exercise device should be adjustable in order to accommodate the size of the user of the device. The present invention fulfills these needs and provides other related advantages.

DESCRIPTION OF THE PRIOR ART

U.S. Pat. No. 5,769,766 to Chin-Lien Huang. This patent describes an abdomen and leg building mechanism.

U.S. Pat. No. 5,112,287 to Brewer uses tensioning members to provide the resistance when a person pulls up on handles.

U.S. Pat. No. 5,334,120 to Rasmussen describes a gravity exercise machine that uses pulleys and ropes to connect to weights.

U.S. Pat. No. 4,600,196 to Jones describes an exercise machine with variable resilient members in conjunction with weights.

U.S. Pat. No. 4,521,013 to Dofel utilizes a mechanical resistance assembly that employs a resilient strap which is stretched by use of a pulley system.

SUMMARY OF THE INVENTION

It is the object of the present invention to provide an apparatus to exercise at least four groups of muscles.

It is another object of the present invention to exercise at least the abdominal muscles, the serratus muscles, the intercostal muscle and the leg muscles.

It is yet another object of the present invention to provide an apparatus that can be efficiently and economically manufactured.

Briefly, in accordance with the present invention, there is provided an exercise apparatus that has a first frame with a connecting member attached to the bottom of the frame and a second frame with a connecting member attached to the bottom of the frame. The two frames are connected by a hinge pin and a hinge member that breaks in the center and allows the exercise apparatus to be folded for storage. The upper portion of the first frame has two handgrips attached thereon. A seat member is hinged to the two frames that have another frame that rotates about a point where the two frames are attached at their upper end. The seat member has extended downward a member that has a footrest. Attached to the footrest is a flexible strip to prevent the seat member from going too far backwards.

When an exerciser leans backward, the seat member will rotate and the flexible strip stops the backward movement. The exerciser can then start forward and begin exercising the four groups of muscles.

These and other objects, features and advantages of the present invention will become more readily apparent upon detail consideration of the following Description of the Preferred Embodiment with reference to the accompanying Drawings.

BRIEF DESCRIPTION OF THE DRAWINGS

In the drawings which illustrate the best made presently contemplated for carrying out the present invention.

The novel features which are believed to be characteristics of the invention, both as its organization and its method of operation, together with further objects and advantages thereof, will be better understood from the following description in conjunction with the accompanying drawings in which the presently preferred embodiment of the invention is illustrated by way of example. It is expressly understood, however, that the drawings are for purposes of illustration and description only, and are not intended as a definition of the limits of the invention.

DETAILED DESCRIPTION OF THE PREFERRED EMBODIMENT

Figure 1:
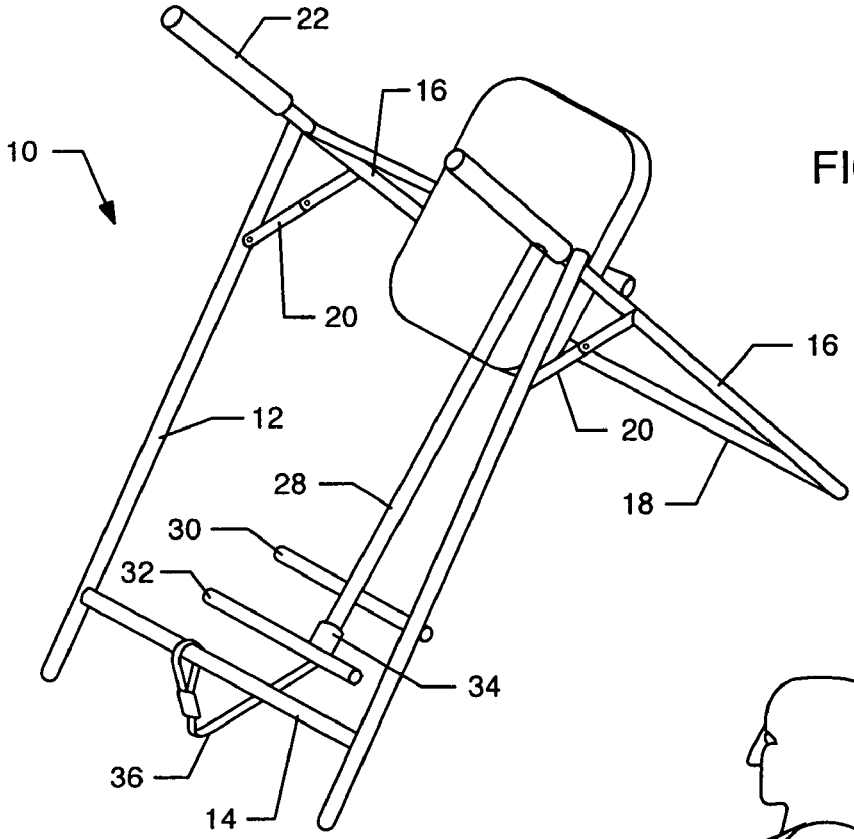
FIG. 1 is an isometric view of the present invention.
Figure 2:
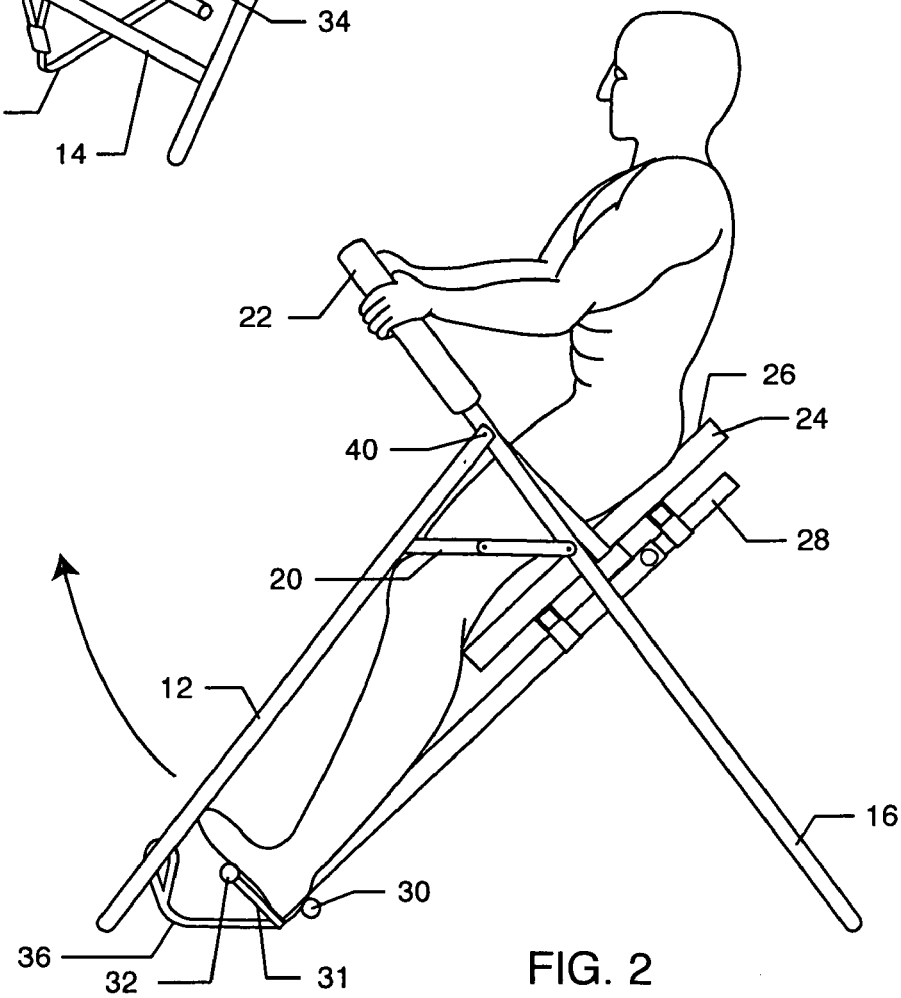
FIG. 2 is a left side view of the present invention showing an exerciser in place.
Figure 3:
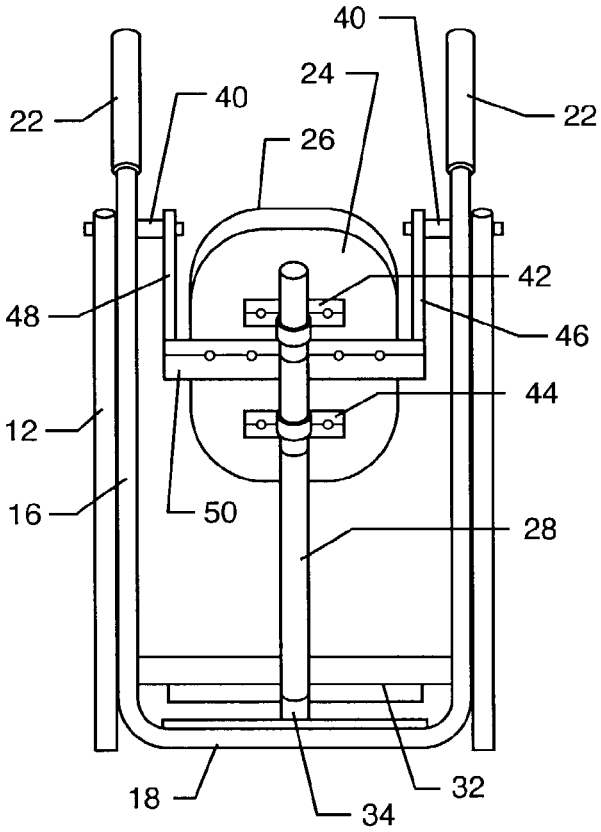
FIG. 3 is a rear view of the present invention.
Figure 4:
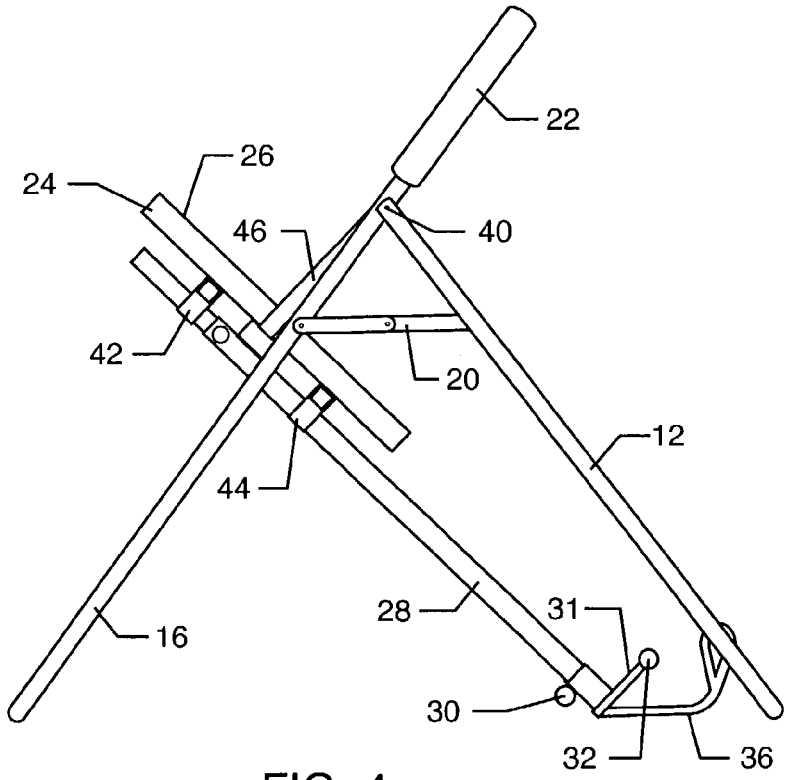
FIG. 4 is a right side view of the present invention.
Figure 6:
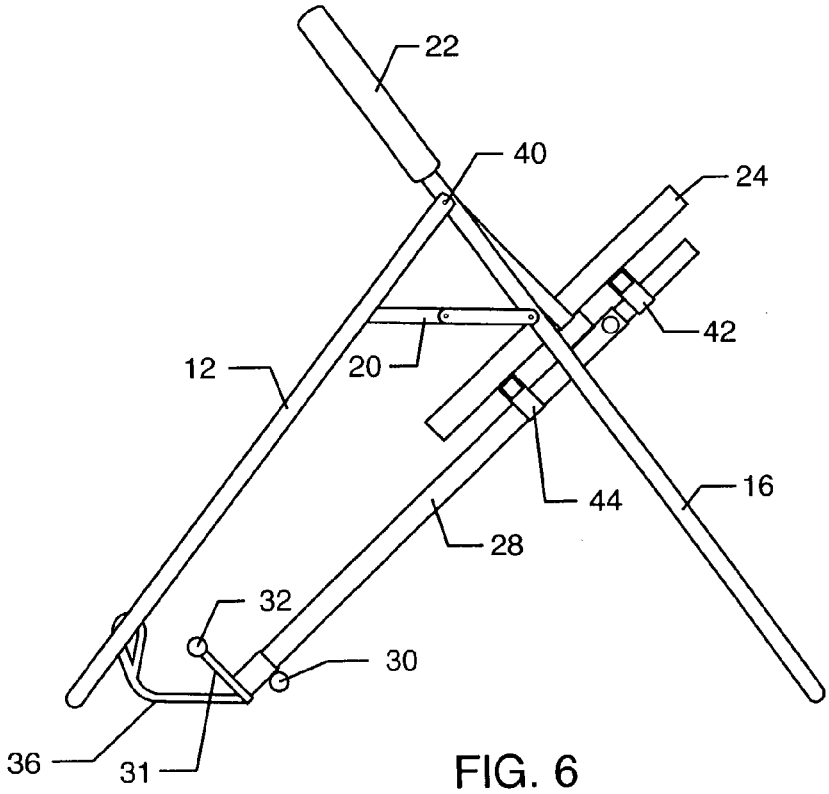
FIG. 6 is a left side view of the present invention.

Turning now to FIG. 1, there is seen an isometric view generally shown as 10. The exercise apparatus has a frame comprising of two portions, namely a frame 12 with a connecting member 14 attached to the bottom portion of frame 12 and a frame 16 connected to frame 12 by a hinge pin and (as seen in FIG. 3). Frame 16 has a connecting member 18 attached to the bottom of frame 16. Frames 12 and 16 are connected by hinge member 20 that breaks in the center and allows the exercise apparatus to be folded for storage. The upper portion of frame 16 has two hand grips 22 which gives the exerciser, as seen in FIG. 2, a firmer grip. A seat 24 is made from a hard material such as wood or plastic and is covered by a foam and waterproof material 26. Also seen in this view is a center bar 28 which can be seen in more detail in FIG. 3. Attached to the back side of the center bar 28 is a footrest 30 whereby the Exerciser rests the heel when exercising as shown in FIG. 2. Attached to a fitting 34 on the bottom of the center bar 28 is a footrest 32 where the exerciser rests the sole of the foot which is also shown in FIG. 2. The footrest 32 extends outward by a footrest extension member 31 which is seen in FIGS. 2, 4 and 6. Also seen in FIG. 1 is a flexible strap 36 connecting member 14 to center bar fitting 34. This strap limits the exerciser when moving backward to a position where the exerciser can start forward and begin exercising the four groups of muscles.

Turning now to FIG. 2 there is seen an exerciser positioned on the present exercise apparatus in the forward position. The exerciser is positioned on the seat 24 and the feet are on footrest 30 and 32.

FIG. 3 shows a rear view of the present exercise apparatus. In this view there is seen the seat 24 and hinge pins 40 that connect frames 12 and 16 which allows frames 12 and 16 to rotate around hinge pins 40. Also seen in this view is the center bar 28 which is fastened to the seat 24 by fasteners 42 and 44. This view also shows a cradle member having cradle arms 46 and 48 where the upper ends of arms 46 and 48 rotate around hinge pin 40. The cradle arms 46 and 48 are attached on the lower end by a cradle cross member 50. Cradle cross member 50 is fastened to seat bottom 24 by screws of some other suitable means.

FIG. 4 shows the right side of the present exercise apparatus.

Figure 5:
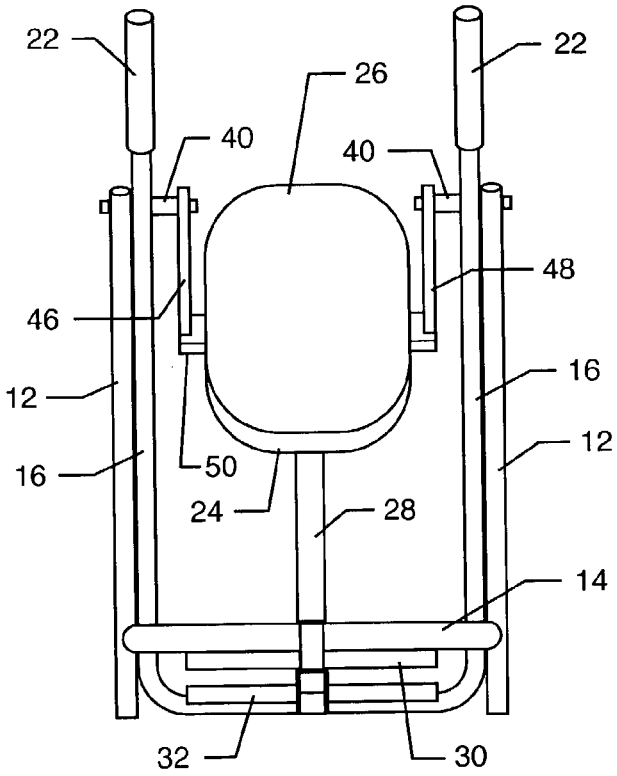
FIG. 5 is a front view of the present invention.

FIG. 5 shows the front view of the present exercise apparatus.

FIG. 6 is a left side view of the present exercise apparatus and is a mirror image of that shown in FIG. 4.

The disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Although an embodiment has been described in detail for purposes of illustration, various modifications may be made without departing from the scope and spirit of the invention.

What is claimed is:

1. An abdominal exercise device comprising:
a support frame;
nonrotating handles extending from the frame;
a seat pivotally associated with the frame;
a footrest associated with the seat; and
a means for limiting backward rotation of the seat, wherein the means for limiting backward rotation of the seat comprises a flexible strap.

2. The device of claim 1, including a bar attaching the footrest to the seat, wherein the bar and the footrest pivot with the seat.

3. The device of claim 1, including a cradle pivotally associated with the frame and supporting the seat.

4. The device of claim 1, wherein the frame comprises two portions, with the seat pivotally disposed therebetween.

5. The device of claim 4, wherein the frame is collapsible.

6. The device of claim 5, including connecting members attached to and connecting the two portions of the frame.

7. The device of claim 6, including folding hinge members attached to the two portions of the frame, whereby these portions may be moved between a locked, open position and a collapsed position.

8. An abdominal exercise device comprising:
a support frame, comprised of two portions;
nonrotating handles extending from the frame;
a seat;
a cradle, pivotally associated with the portions and disposed therebetween, and supporting the seat;
a footrest;
a bar attaching the footrest to the seat, wherein the bar and the footrest pivot with the seat; and
a flexible strap associated with the footrest, whereby backward rotation of the seat is limited.

9. The device of claim 8, wherein the frame is collapsible.

10. The device of claim 8, including connecting members attached to and connecting the two portions of the frame.

11. An abdominal exercise device comprising:
a support frame comprised of two portions pivotable relative to one another;
a seat pivotally disposed between the two portions of the frame;
a footrest associated with the seat; and
a means for limiting backward rotation of the seat, wherein the means for limiting backward rotation of the seat comprises a flexible strap.

12. The device of claim 11, including a bar attaching the footrest to the seat, wherein the bar and the footrest pivot with the seat.

13. The device of claim 11, including a cradle pivotally associated with the frame and supporting the seat.

* * * * *